US010844559B2

(12) United States Patent
Ptacek et al.

(10) Patent No.: US 10,844,559 B2
(45) Date of Patent: Nov. 24, 2020

(54) TRAFFIC FLOW BARRIER WITH CORRESPONDING PRODUCTION MOLD AND HAND CART

(71) Applicant: WARNING LITES OF MINNESOTA, INC., Minneapolis, MN (US)

(72) Inventors: James Ptacek, Minneapolis, MN (US); Steven D. Larson, Minneapolis, MN (US); Scott Brierley, Minneapolis, MN (US)

(73) Assignee: WARNING LITES OF MINNESOTA, INC., Minneapolis, MN (US)

( * ) Notice: Subject to any disclaimer, the term of this patent is extended or adjusted under 35 U.S.C. 154(b) by 0 days.

(21) Appl. No.: 16/396,112

(22) Filed: Apr. 26, 2019

(65) Prior Publication Data

US 2019/0330812 A1 Oct. 31, 2019

Related U.S. Application Data

(60) Provisional application No. 62/663,880, filed on Apr. 27, 2018.

(51) Int. Cl.

| | |
|---|---|
| ***E01F 13/00*** | (2006.01) |
| ***E01F 15/00*** | (2006.01) |
| ***E01F 9/623*** | (2016.01) |
| ***E01F 13/02*** | (2006.01) |
| ***B66F 9/06*** | (2006.01) |

(Continued)

(52) U.S. Cl.

CPC ..... *E01F 15/003* (2013.01); *B28B 7/0014* (2013.01); *B28B 7/20* (2013.01); *B66F 9/06* (2013.01); *E01F 9/623* (2016.02); *E01F 9/692* (2016.02); *E01F 13/022* (2013.01); *B28B 2007/005* (2013.01)

(58) Field of Classification Search

CPC ..... E01F 9/623; E01F 9/692; E01F 13/022; E01F 15/003; B28B 7/0014; B28B 7/20; B28B 2007/005

USPC ..... 404/6

See application file for complete search history.

(56) References Cited

U.S. PATENT DOCUMENTS 817,282 A * 4/1906 Stewart ..... E04H 17/08 256/19

4,290,585 A * 9/1981 Glaesener ..... E01F 15/146 256/13.1

(Continued)

*Primary Examiner* — Raymond W Addie

(74) *Attorney, Agent, or Firm* — J.A. Lindeman & Co., PLLC

(57) ABSTRACT

A barrier system is used to direct and block a travel path of pedestrians and vehicles. The barriers may be shaped substantially as a truncated pyramid with a base surface and planar sides extending from the edges of the base surface to a top portion, where the cross-sectional area of the base surface is larger than the cross-sectional area of the top portion. The angles of inclination between the planar sides and the interior of the base surface are acute angles. The bollard can be cast from heavy dense materials. The bollard includes at least two overhanging lips on the planar sides of the barrier between the base surface and the top portion. The configurations of the bollards provide improved placement, such as with cranes, hand carts, and other devices. Molds to cast the barriers and hand carts to move the barriers are also disclosed.

10 Claims, 9 Drawing Sheets

(51) Int. Cl.

| | |
|---|---|
| ***B28B 7/00*** | (2006.01) |
| ***B28B 7/20*** | (2006.01) |
| ***E01F 9/692*** | (2016.01) |

(56) References Cited

U.S. PATENT DOCUMENTS

| | | | | | |
|---|---|---|---|---|---|
| 4,934,661 | A * | 6/1990 | Denman | E01F 15/146 | 256/1 |
| 5,054,954 | A * | 10/1991 | Cobb | E01F 15/083 | 256/13.1 |
| 5,137,391 | A * | 8/1992 | Ballesteros | E01F 15/083 | 404/6 |
| 5,336,016 | A * | 8/1994 | Baatz | B29B 17/0042 | 256/13.1 |
| 7,588,387 | B1 * | 9/2009 | Christensen | E01F 15/083 | 256/13.1 |
| 2003/0086761 | A1 * | 5/2003 | Anderson | E01F 13/12 | 404/6 |
| 2016/0060830 | A1 * | 3/2016 | Muegerl | E01F 15/083 | 404/6 |

* cited by examiner

TRAFFIC FLOW BARRIER WITH CORRESPONDING PRODUCTION MOLD AND HAND CART

CROSS REFERENCE TO RELATED APPLICATION

The present application claims the benefit of priority to Provisional Patent Application No. 62/663,880, filed Apr. 27, 2018, the entire contents of which are incorporated by reference in this application.

TECHNICAL FIELD

This technology relates to protective barriers and bollards used to direct pedestrian and vehicular traffic flow. More specifically, the technology relates to barriers that feature an overhanging edge or "lip" at their base that facilitates lifting, moving, and positioning the barrier in one or more locations, as well as molds for making those barriers.

BACKGROUND

There are many different types of road barriers that are useful for controlling crowd flow and preventing vehicles from entering a particular area, including cylindrical and other shaped bollards, Jersey walls, interlocking plastic barriers, and others. For example, when an event is held at a venue such as stadium, auditorium, or a parking lot, it is often desirable to control crowd flow and to erect barriers to prevent entry by vehicles. Bollards that are capable of being moved from one location to another are particularly advantageous for such events because they allow for flexibility in the design and creation of floor plans and facility configurations that can be adapted or altered for the particular type of event. Existing types of bollards have some drawbacks, however. In some instances, for example, the bollards are secured to the floor, restricting the options available for floor plans. In some instances, the bollards are of such significant size and mass that they may not be moved easily. Other types of barriers have similar problems. For example, a Jersey barrier is a modular barrier of significant length, e.g., between 10 to 12 feet, and significant weight. The excess length can create a bottleneck at entry points causing a long wait time for event attendees. Jersey barriers also may not be moved efficiently from one location to another as they often require customized cranes and lifts to effectively hold and move the barrier.

Some previously known alternatives for solving these problems involve using bollards or other types of barriers that are composed of a lighter material, such as plastic. However, such barriers composed of plastic are often ineffective in controlling vehicular and pedestrian traffic flow as people can easily move the barrier out of their way, thereby defeating the purpose of the barrier. A bollard composed of a heavier material such as concrete or steel, by contrast, provides a sturdy structure forcing a person to move in a desired direction. Bollards composed of a heavier material also act as a vehicle deterrent as well. For example, a driver will be less likely to attempt to run over a concrete bollard for fear of damaging their car. A concrete bollard can also be used as a type of anchor for a variety of purposes, such as secure placement of tents and signage.

By design, a bollard is a cumbersome and difficult object to move. Securing a bollard to the ground, moreover, eliminates much of the utility of the bollard. Thus, having the ability to move bollards expeditiously to create various paths and layouts for different events is highly desirable. For example, a venue hosting a sports event one day and a charity event the next day may require different entry points, paths, safety precautions, and other considerations. Having bollards that are both sufficiently heavy and which may be more easily and efficiently transported enables greater flexibility and variety in the configurations and utility of the bollards. For example, some bollards can fill smaller gaps, such as between a wall and solid object. Some entry points, for example, are only 4-8 ft. wide but still need to be restricted to create a gap no greater than a 5 ft. wide (e.g., based on a smallest car width of 5.5 ft. wide). In these cases, a 10-12 ft. long Jersey barrier is too long to provide the desired configuration. Additionally, the use of smaller bollards allows for the production and configuration of more appealing and inviting objects rather than dangerous-looking and fear-inducing objects. The appealing and inviting objects offer further advantages such as anchoring tents, providing signage locations and display areas, as well as advertising and notice space.

In the past, cranes or other special equipment, such as barrier transfer machines and zipper machines, were required to move bollards from one location to another. It is often impractical to use a barrier transfer machine or zipper machine in a public venue, however, as these machines are designed to move barriers across a lane of traffic rather than out of a truck and over significant distances, such as when unloading barriers and placing them at outdoor activity sites, such as stadiums and other entertainment venues.

Hand carts, pallet jacks, and other manual pronged or forked carts also can be used to move heavy loads, and hydraulic carts and forklifts enable workers to move even more substantial loads. However, many hand trucks are incompatible and impractical to move traffic barriers, and specialized equipment and their operation is costly and inconvenient. Hand carts are often used in a variety of venues and offer a more economical and practical solution for moving heavy objects at different events. A venue may own and store multiple hand carts for efficiently setting up an event, but such hand carts may not work effectively with bollards or other barriers of differing shapes and weights.

While a few previously known hand carts have been modified to allow users to move heavy loads by hand, none have been designed to move road barriers. U.S. Pat. No. 3,982,767 (Larsson, et al.) and U.S. Pat. No. 4,589,669 (Kedem) discuss hand trucks for moving pallets but do not include inner flanges for moving road barriers. Similarly, U.S. Pat. No. 6,551,050 (Kallevig, et al.) outlines an attachment for skid loaders that combines a forklift mast with adjustable rolling outriggers. It relies on a rolling stabilizer fork lift attachment and does not include flanged forks for moving road barriers. U.S. Pat. No. 6,331,025 (Douglas) provides a barrier lifting mechanism shaped like a claw but requires a crane. U.S. Pat. No. 8,979,099 (Ellis) discloses an adjustable fork pallet jack but is not suitable for outdoor use. Other pre-cast barriers, such as those described in U.S. Patent Publication No. U.S. 2003/0086761 (Anderson) have been formed with irregular opposing faces that have different angles of inclination. This type of barrier has a non-centric center of gravity and lists to one side when lifted with its top eyebolt or from the bottom with its lifting slots.

Other previously known bollards do not have a lip, or overhang, on their base or, in some instances, have no lip at all. Others may feature slots on their bottom to allow a motorized forklift to move them but cannot be handled or moved with hand carts or other mechanical means. In addition, as noted above, previously known concrete bollards often require specialized and expensive equipment to move them. Other barriers, such as Jersey barriers, may be effective for event traffic control in creating a perimeter to deter vehicular traffic but create choke points for pedestrian traffic.

Other previously known types of barriers have been made from a semi-rigid plastic material with an opening to permit liquid to be introduced into the interior to give weight or ballast and an opening near the bottom to permit the liquid to be drained in order that the barriers might be easily moved for relocation. These plastic barriers have problems as well. One disadvantage of these later barriers is the intricate means of interlocking one barrier end onto another such that problems were occasioned by production molding of the barriers. Additionally, one type of barrier required lifting and sliding the ends into interlocking relation while other barrier types required use of a metal pin or post to join them. Further, the construction type barrier is generally not of a configuration and height to be conveniently used in spectator type situations.

SUMMARY

The systems and methods of the claimed invention provide a pedestrian and vehicular barrier that is simultaneously heavier, thereby discouraging unauthorized movement, and yet easier to move, position, and configure than previous barriers, and provides a visually pleasing, movable barrier for cordoning a path, area, or structure.

In one example embodiment of the invention, the barrier is a pyramidal bollard that is manufactured of a dense, heavy material. The generally pyramidal shape is formed by a base surface, an opposing top section, a front planar surface with an opposing rear planar surface, and two opposing side surfaces. In this example embodiment, the angles of inclination from the front, rear, and side surfaces with respect to the base surface are acute angles. The top section and the base surface are substantially parallel to each other and to the support surface, which can be the ground, an asphalt parking lot, a dirt or grass surface, or other support surface. Recessed portions of the planar walls create an overhanging edge or lip, which allows a user to grasp the barrier with a grapple boom as opposed to previously known and less-desirable methods such as using a forklift or crane hook.

The pyramidal bollard's shape and its heavy weight provide a significant deterrent to any vehicle that might try to drive over or through the barrier. The shape, size, and weight of the pyramidal bollard likewise make it difficult to dislodge, push, or otherwise move the barrier if hit by a vehicle. The pyramidal bollard's shape and strength and heft can be used to create a security ring around a building or location. They allow pedestrian foot traffic to enter the area while preventing vehicles from passing through. The barriers of the invention provide improvements over prior systems, such as Jersey barriers for example, because their shorter length and geometry eliminates the pedestrian foot traffic bottlenecks at the openings of Jersey barriers, which are typically between 10 and 12 feet long. The barriers of the invention prevent vehicular traffic while allowing pedestrians to easily pass on either side.

The configuration and manufacture of the pyramidal bollard, including the overhanging edge or lip, provides improved speed in loading and moving the barriers, improved safety in handling, and exceptional accuracy in placing the barrier in a desired location.

Speed improvements are realized by minimizing the equipment needed to move the pyramidal bollard from point A to point B through the use of a grapple boom truck. The configuration and manufacture of the pyramidal bollard allows a grapple boom to load and unload the barriers on its own, whereas prior designs require a separate forklift to place barriers on a truck and then remove them. Additionally, a grapple boom allows an operator to pick up and move two pyramidal bollards at the same time, which cuts time on station by half.

Handling the pyramidal bollards of the claimed invention is much safer than handling previously known barriers. Picking up the pyramidal bollard of the invention by the bottom is considerably safer than picking up barriers by a hook on the top as with previous systems. Concrete and other materials have the potential to deteriorate over time and therefore, increase the potential of a hook coming out of the barrier material. Additionally, many differently shaped barriers have a tendency to swing with inertia when lifting and moving them with a hook or loop. This creates a significant safety hazard for anyone in the immediate area while the barrier is being moved. The pyramidal bollards of the invention, by contrast, are configured and manufactured with an overhanging edge portion, or lip, that is formed by the base and the planar sides and provides an easy access lifting and transport point, thereby negating any additional swinging and inertial movements and ensuring that an operator has complete control of the barrier when lifting, moving, and positioning it.

Further, the edge portion of the pyramidal bollard provides improved control and accuracy than previous systems. By accommodating a grapple boom, the pyramidal bollard of the claimed invention allows the operator to secure the barrier below its center of gravity, which provides more control and accuracy when lifting, moving, and placing it.

In addition to the pyramidal bollard itself, another example embodiment of the invention includes a method of limiting vehicular access to a designated area by providing a perimeter barricade formed from several barriers. The pyramidal bollards can be placed adjacent to one another, spaced apart from one another, or joined together with a connecting member, such as a chain or rope that passes through an aperture in each bollard. The spaces between adjacent bollards allow pedestrians to move between the barriers and provide efficient foot traffic without creating bottlenecks. Vehicular access is limited when they reach the pyramidal bollards as further vehicular travel will result in a collision with the barrier, or in the case of linked bollards, a striking of the connecting member and encountering the weight and tension of the barricade. When a vehicle strikes a pyramidal bollard at a slower speed or a shallower angle and is not stopped or otherwise disabled by the barrier, the inertia of the barrier(s) and connecting members will slow and stop the vehicle.

Another example embodiment of this invention provides a mold or form that is processed, shaped, sized and configured to produce a pyramidal bollard in accordance with the invention. The molds are designed to produce a concrete (or other material) barrier with the shape and geometry described in this application. The molds are constructed and placed upside down, with the smaller top portion of the barrier to be formed at the bottom of the mold, and the larger base of the barrier to be formed at the top of the mold. As concrete or another material fills the mold and cures, a pyramidal bollard in accordance with the invention is formed.

The configuration and manufacture of the molds allows for the consistent and uniform production of pyramidal bollards in accordance with the invention. Those barriers provide improved performance and offer different features and capabilities than prior systems.

Another example embodiment of the invention includes a hand cart configured and manufactured to lift, move, and position the pyramidal bollards safely and efficiently. The hand carts in accordance with the invention are configured and manufactured to complement and to take advantage of the unique geometry of the pyramidal bollards in fitting and engaging the barriers.

One example embodiment of the invention includes a pyramidal bollard with an overhanging lip on at least two sides. The barrier includes a rectangular base formed as a bottom support surface of the barrier. The rectangular base includes a length, a thickness, and a width. The barrier also includes a rectangular curb formed above the base and in cooperation with the rectangular base, where the rectangular curb includes a length, a thickness, and a width, and where the length of the rectangular curb extends beyond the length of the rectangular base in both lateral directions to form one or more overhanging lips. The barrier also includes four planar sides each in cooperation with the rectangular curb and each extending vertically from the rectangular curb to a top portion at substantially the same angle of inclination, where the combination of the rectangular curb, the four planar sides, and the top portion form a truncated pyramid above and on top of the rectangular base (in cooperation with the rectangular base).

In one example embodiment of the invention, the rectangular base, the rectangular curb, and the top portion are substantially parallel. The top portion can be the truncated portion of the pyramid (frusto-pyramidal). For example, the top portion includes a length, and the length of the rectangular curb is greater than the length of the top portion.

The invention can have a base and a curb that are both square. That is, the length and the width of the rectangular base are substantially the same and the length and width of the rectangular curb are substantially the same. Further, the top portion can also be square, where the top portion includes a length and a width, and the length and the width of the top portion are substantially the same.

In some example embodiments of the invention, the planar sides are the same size to form a (right) pyramid. That is, each of the four planar sides has a length and a width, and the four planar sides are two pairs of opposing planar sides, where each of opposing planar sides has substantially the same respective length and the same respective width.

Similarly, in some embodiments of the invention, the opposing pairs of sides do not have the same width. For example, each of the four planar sides has a length and a width, and the four planar sides are two pairs of opposing planar sides, but each of the opposing planar sides of the pair of planar sides has substantially the same respective length and the same respective width but are different than the other pair of opposing planar sides.

In some embodiments, the barrier can include an attachment point, such as a hook or a loop, for example. The barrier can be made of a pre-cast material such as cement or concrete.

In some embodiments of the invention, the barrier can have four overhanging edges or lips. For example, the width of the rectangular curb can extend beyond the width of the rectangular base in both lateral directions to form the one or more overhanging lips.

Other embodiments of the invention include molds to form the barriers described in the application. One embodiment of the invention includes a mold assembly for forming a barrier to vehicle passage. The mold assembly includes a mold with an open top and at least one cavity disposed between side walls of the mold for receiving and molding concrete barriers. The mold includes a rectangular top portion formed as a bottom surface of the mold, and the rectangular top portion includes a length and a width. The mold also includes four planar side walls each in cooperation with the rectangular top portion and extending vertically from the rectangular top portion to a rectangular curb portion at substantially the same angle of inclination. The combination of the rectangular curb portion, the four planar side walls, and the rectangular top portion form an inverted truncated pyramid. The mold also includes a pair of rectangular base inserts in cooperation with the four planar side walls, where the rectangular base inserts are positioned at the open top of the mold to form a rectangular base area and an overhanging lip between the rectangular base area and the rectangular curb portion.

In some example embodiments of the invention, the rectangular base inserts, the rectangular curb portion, and the rectangular top portion are substantially parallel. The top portion is the truncated portion of the pyramid where the rectangular top portion includes a length, and the length of the rectangular curb portion is greater than the length of the rectangular top portion. In some embodiments the mold forms a square base and curb. That is, the length and the width of the rectangular base inserts are substantially the same and the length and width of the rectangular curb portion are substantially the same. Further, the rectangular top portion can also be a square, where the rectangular top portion includes a length and a width, and the length and the width of the rectangular top portion are substantially the same.

To form a right pyramidal barrier, some example embodiments of the mold assembly invention have planar sides that are the same size to form a (right) pyramid, where each of the four planar side walls has a length and a width, and where the four planar side walls are two pairs of opposing planar side walls, and each of opposing planar side walls has substantially the same respective length and the same respective width.

Similarly, in some embodiments of the invention, the opposing pairs of planar side walls do not have the same width. For example, each of the four planar side walls has a length and a width, and the four planar side walls are two pairs of opposing planar side walls, but each of the opposing planar side walls of the pair of planar side walls has substantially the same respective length and the same respective width but are different than the other pair of opposing planar side walls.

In some embodiments, the mold can include an attachment point insert, such as a hook or a loop, for example. The attachment point insert can be positioned in the rectangular top portion of the mold, and the attachment point insert can cooperatively receive a hook or loop or other attachment point.

In some embodiments of the invention, the mold can be used to form a barrier having four overhanging edges or lips. For example, the width of the rectangular curb portion can extend beyond the width of the rectangular base area in both lateral directions to form the one or more overhanging lips.

Other embodiments of the invention include hand carts to lift, move, and position the barriers described in the application. One embodiment of the invention includes a hand cart adapted for lifting and moving a barrier that includes a frame, a rear wheeled truck, a jack, forks, and panels connected to a slide bar.

The frame extends on lateral sides to a pair of outriggers, and the rear wheeled truck is pivotally coupled to the frame. The jack is mounted between the rear wheeled truck and the frame and is adapted for raising and lowering the frame relative to the rear wheeled truck. The forks of the hand cart include a left-side fork with a proximal end and a distal end and a right-side fork with a proximal and a distal end. The hand cart further includes a left-side panel slidably connected to the distal end of the left-side fork and to the slide bar for lateral movement along the slide bar along with a right-side panel also slidably connected to the distal end of the right-side fork for lateral movement along the slide bar. The slide bar is operably connected to the frame. The respective left-side fork and the right-side fork are substantially parallel to one another and are operative for moving laterally toward each other and away from each other along the slide bar to change the distance between each other.

DETAILED DESCRIPTION

FIGS. 1-6 show a pyramidal bollard 105 in accordance with the invention. In one embodiment of the invention, the pyramidal bollard is a structure composed of a single material, e.g., concrete, metal, plastic, and other materials that cannot be moved by pedestrians or by vehicles once set in place. In this embodiment, the pyramidal bollard is a structure composed of a mixture of materials, e.g., a combination of concrete, metal, and/or plastic. In different embodiments of the invention. In one embodiment, the barrier is configured and manufactured based upon two or more shapes, e.g., a square base and a pyramidal shaped top. In one embodiment, the barrier is a single continuous structure, i.e., a barrier is a single component. In one embodiment, the barrier includes two or more components, e.g., a pyramidal shaped structure attached to a square base with a hook attached to a top portion of the pyramidal shaped structure. In some embodiments, the pyramidal bollard includes an indentation or ledge or overhanging section along a bottom side. In this embodiment, the barrier includes a plurality of indentations, ledges, and overhang sections along a base.

The shapes of the pyramidal bollards may be substantially similar in their exact geometric descriptions, such that one skilled in the art would recognize a substantially similar pyramidal bollard to be a pyramidal bollard, as opposed to a different geometrical shape, for example.

The "base" refers to an element of a pyramidal bollard that serves as a bottom support structure of the bollard. In one embodiment, the base refers to the bottom structural component of a barrier having a distinct top and bottom orientation. In one embodiment, a square base forms a first indentation along a first bottom side (lip) and a second indentation along a second bottom side (lip) parallel to the first bottom side.

Figure 6:
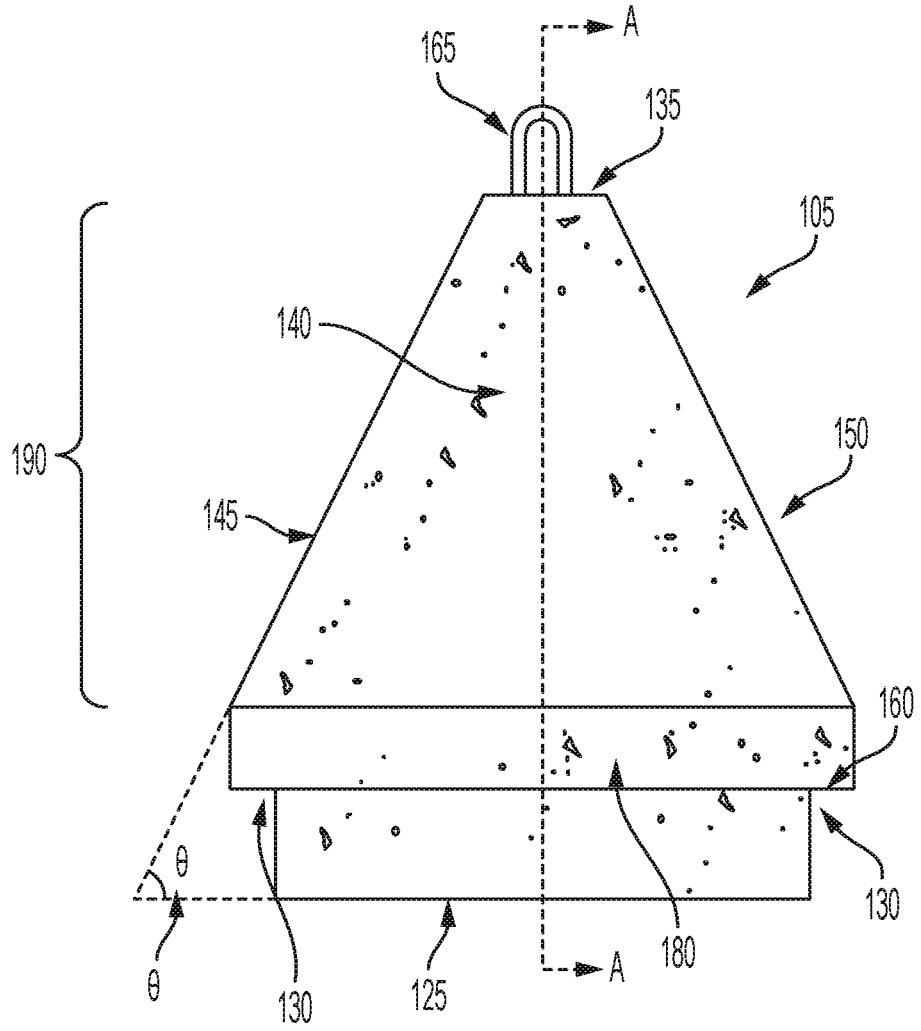
FIG. 6 is an illustration of one embodiment of a pyramidal bollard in accordance with the claimed invention.

FIG. 6 in particular shows one embodiment of the invention with a pyramidal bollard 105 formed by six sides, including front planar surface 140, rear planar surface 155 (not shown in FIG. 6), first planar side 145, second planar side 150, base 125, and top portion 135. The six sides 125, 135, 140, 145, 150, 155 are configured and manufactured to define a substantially pyramidal shape or a frusto-pyramidal (truncated pyramid) shape.

In many example embodiments, the sides of the pyramidal bollard include substantially smooth surfaces, such as even or flat surfaces or layers without protrusions extending above the surface(s). The smooth surfaces (especially planar surfaces 140, 145, 150, and 155) provide a suitable surface upon which to attach an object or display, such as stickers, posters, advertisements, notices, regulatory traffic signs, logos, graphic marks, emblems, decorative elements, symbols, or other information that may be useful to vehicular and pedestrian traffic in the vicinity of the pyramidal bollard 105. In one example embodiment of the invention shown in FIG. 6, the planar surfaces 140, 145, 150, 155 form acute angles θ with respect to base 125. In some embodiments of the invention, the barrier is made of concrete or cement that can be used to form smooth planar surfaces or textured planar surfaces. The planar surfaces can be polished, sanded, or ground down to a desired smoothness by removing ridges or protrusions.

Hooks or other attachment points 165 can be embedded (or otherwise positioned) in top portion 135. The attachment points can be constructed of steel or other metals or durable materials. The attachment points 165 can include materials with a curve or a bend suitable for attaching onto another piece of material. In one example embodiment of the invention, the attachment point is a hook, while in another example embodiment, the attachment point is a loop. Other geometric configurations can be used as the attachment points, including semi-circular curves and U-shapes, for example.

When multiple pyramidal bollard 105 are used as part of a barricade system, a cable or other connection material (not shown in FIG. 6) can extend from attachment point 165 on one pyramidal bollard 105 to an adjacent or other pyramidal bollard to form the larger barricade system. In addition to facilitating the combination of multiple pyramidal bollards into a larger barricade system, attachment points 165 can also provide attachment points for poles, ropes, posts, and other components. Multiple attachment points 165 can be incorporated in a pyramidal bollard 105.

In one use, the base 125 of pyramidal bollard 105 rests on a support surface, which can be the ground, a parking lot, a dirt or grass surface, or other type of surface. The top portion 135 and the base 125 are substantially parallel to each other and to the support surface. The planar sides 140, 145, 150, 155 are configured and manufactured to form a substantially pyramidal shape. As shown in FIG. 6, between the base 125 and the body portion 190 of the pyramidal bollard 105, there is a curb portion 180. Curb portion 180 is configured and manufactured to extend downward from body portion 190 to form a lip 160 above base 125. The amount (distance) of the overhang of the lip 160 beyond the base 125 defines the indentation 130.

In this application, "indentation" refers to a dip, cavity, depression, groove, notch, overhang, lip, or channel along a surface. In one embodiment of the invention, an indentation is along a planar surface of the pyramidal bollard. In one example embodiment, the indentation is along the base of the pyramidal bollard. As outlined above, in one embodiment, the indention creates an overhanging edge (lip) between the curb portion 180 and the base 125, and in one embodiment outlined below (FIG. 7), the indentation creates an overhanging edge (lip) between the body portion and the base. In some embodiments, the indentation is along an entire side of the pyramidal bollard creating a channel or groove. In other embodiments, a barrier comprises a first indentation along a first bottom side of the pyramidal bollard and a second indentation along a second bottom side parallel to the first bottom side. (See FIGS. 6 and 7, for example.) In still other example embodiments of the invention, the curb portion extends on all sides beyond the base, forming indentations along each of the sides of the pyramidal bollard. In the example pyramidal bollard, each of the four sides has an indention between the base and the curb.

Figure 7:
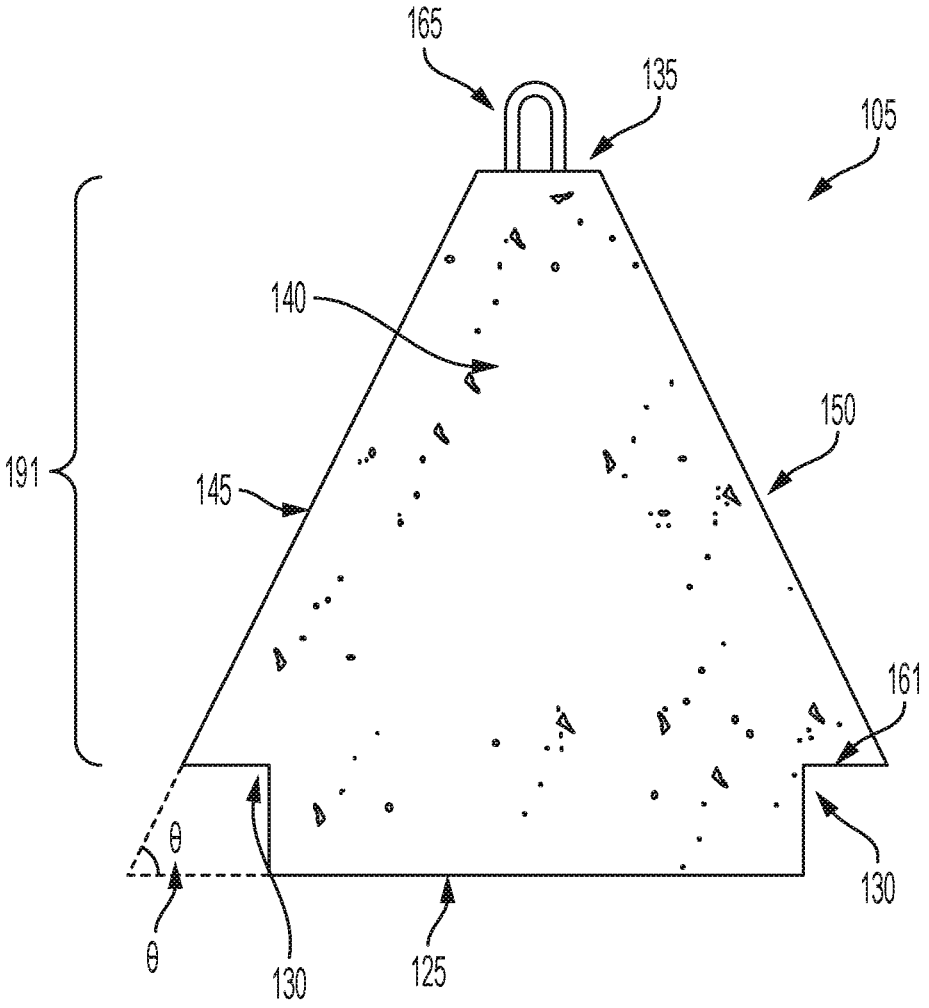
FIG. 7 is an illustration of another embodiment of a pyramidal bollard in accordance with the claimed invention.

FIG. 7 shows an alternative embodiment of the invention where the body portion 191 of the pyramidal bollard 106 extends to the base 125, and there is no curb portion. In this embodiment, the planar sides 140, 145, 150, 155 are configured and manufactured to overhang base 125 and form lip 161.

The planar surfaces 140, 145, 150, 155 as well as the lip 160 and base 125 and other exposed edges that form indentation 130 can be chamfered to minimize damage to the pyramidal bollard 105 during transportation, positioning, and moving the bollard 105.

The indentations 130 provide a secure area on the structure of the pyramidal bollard to lift or otherwise elevate the pyramidal bollard 105 and to move the pyramidal bollard 105 from one location to another. In one example embodiment shown in the cross-sectional view of FIG. 8, the pyramidal bollard 105 includes a first indentation 130A along a first bottom side 132 of the pyramidal bollard 105 and a second indentation 130B along a second bottom side 133 parallel to the first bottom side 132. In one embodiment, the pyramidal bollard includes a square base 125 with each side of the base measuring 30 inches. In one embodiment, the pyramidal bollard is 36 inches tall, from the bottom of the base 125 to top portion 135.

Figure 8:
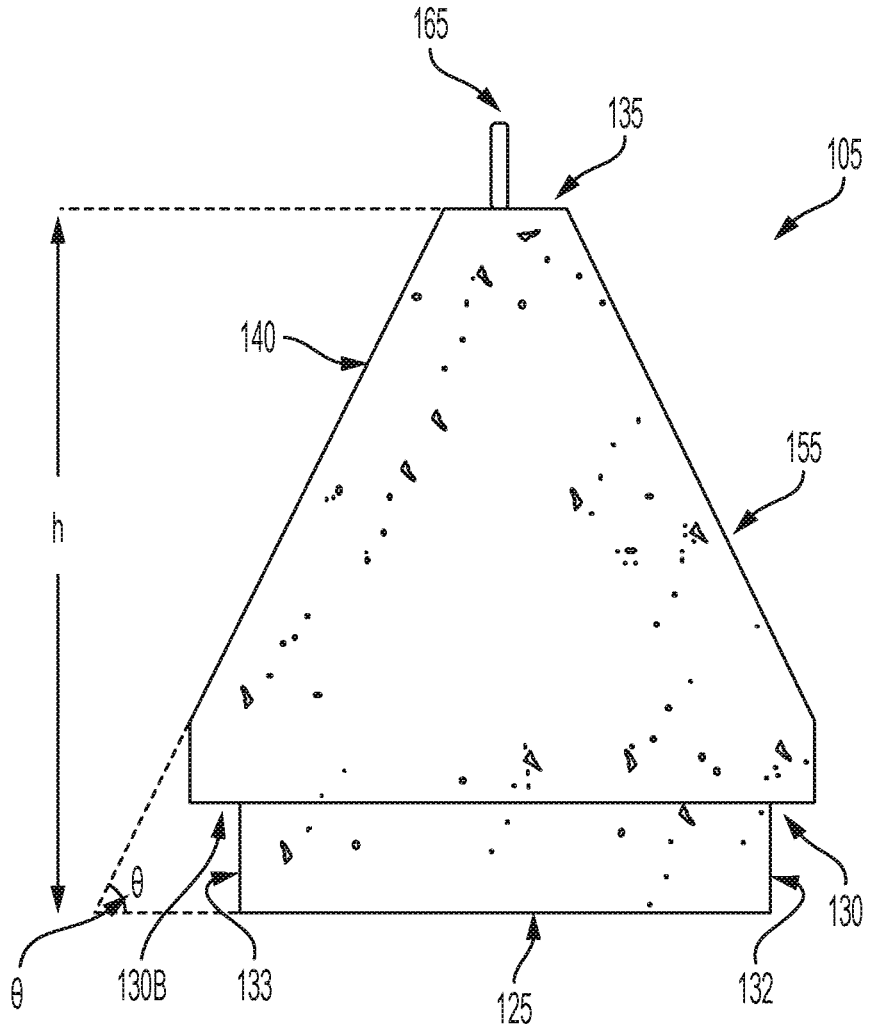
FIG. 8 is a cross sectional view of a pyramidal bollard in accordance with the claimed invention along line A-A in FIG. 6.

FIG. 8 shows a cross-sectional view of one example embodiment of the invention as seen along lines A-A in FIG. 6. The top portion 135 is smaller than the base 125 and provides stability for the pyramidal bollard 105 by way of its geometric configuration. Attachment point 165 is incorporated into the top portion 135 of the pyramidal bollard 105. Attachment point 165 can be cast in the material of pyramidal bollard 105 or can be threaded into the material of the pyramidal bollard 105 or otherwise incorporated into a mating pair with a corresponding portion of the pyramidal bollard 105. Attachment point 165 is shown on top portion 135 and be used as the point of attachment of additional elements (not shown) such as poles, sign posts, light supports, etc.

In contrast to previously known barriers and barrier systems, the planar surfaces 140, 145, 150, 155 of the pyramidal bollard claimed in the invention each have substantially the same angle of inclination θ from the horizontal base. For example, in some embodiments of the invention, the angle of inclination θ can be in the range of 30° to 75° from the respective imaginary horizontal axis, shown in an extended broken line along base 125 of barrier 105 in the FIGS. Depending upon the desired height, h, of the barrier 105, the angles of inclination θ can be adjusted. In one example embodiment of the invention, the height, h, of the pyramidal bollard is approximately 36 inches, the planar sides are 34 inches long, the curb portion 180 is approximately 4 inches thick and approximately 30 inches long, with the base 125 of approximately two inches thick and 23 inches long. The indentations 130 are 3.5 inches, and the angle of inclination θ is approximately 69°. Each of the planar surfaces 140, 145, 150, 155 have substantially the same angle of inclination θ, which provides a low center of gravity along the midlines of the pyramidal bollard 105, as opposed to prior systems that had planar surfaces of different lengths forming different angles of inclination, which resulted in a center of gravity of the barrier that was not along the midline(s). The offset center of gravity made it difficult to control the barrier when lifting it and attempting to move it. The pyramidal bollard 105 of the invention solves this problem and provides a barrier that is much easier to lift, move, and place.

Boom Crane Example

FIGS. 10A-10D show the lifting, moving, and transportation capabilities afforded by the barrier invention used in conjunction with a boom crane. The pyramidal bollards of the claimed invention include geometric features that facilitate lifting, moving, and positioning the barriers. One example embodiment of the invention includes a pyramidal bollard that can be lifted, moved, and positioned in tandem with a second, like, pyramidal bollard. The configuration of the planar sides, base, and indentations (e.g., overhang) provide a solution to the shortcomings in the prior state of the art by providing a faster manner of lifting, moving, and positioning the pyramidal bollards.

Figure 10A:
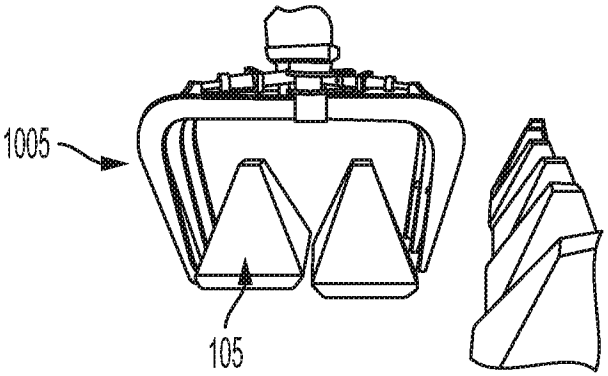
FIGS. 10A-10D show the lifting, moving, and transportation capabilities afforded by the invention used in conjunction with a boom crane.
Figure 10B:
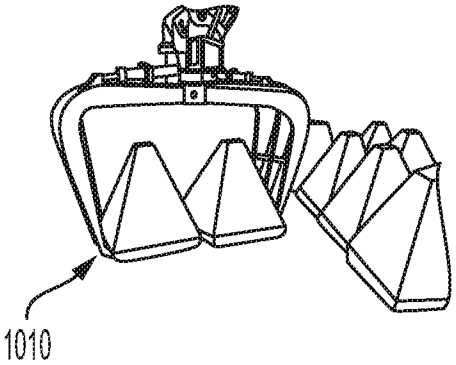

FIG. 10A shows a boom crane with an attached clamshell bucket 1005 approaching two pyramidal bollards 105 of the invention. The clamshell bucket is an articulating two-piece bucket, mechanically hinged at the middle to form a claw-like appendage with an internal volume. FIG. 10B shows the clamshell bucket 1005 with its forks 1010 engaging the pyramidal bollards 105. Specifically, the forks 1010 engage the indentations 130 formed by the base 125 and curb portion 180 at the underside of the lip 160 on each of the pyramidal bollards 105.

Figure 10C:
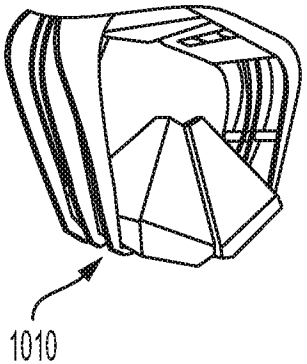
Figure 10D:
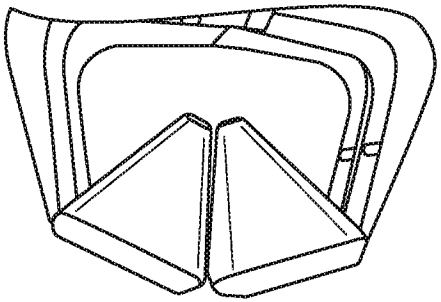

FIG. 10C shows the boom crane lifting the engaged clamshell bucket 1005. As the boom crane lifts the clamshell bucket 1005, the lateral forces of the bucket 1005 bring the bases 125 of each pyramidal bollard 105 together, while the upward force of the forks 1010 on the indentation 130 and lip 160 of the respective pyramidal bollards 105 cause the top portions 135 of the pyramidal bollards 105 to rotate toward each other. The rotation stops when the planar surfaces of the respective pyramidal bollards 105 are in full contact with each other as shown in FIGS. 10C and 10D, for example. The high coefficients of friction of the planar surfaces and the large surface areas of the engaged planar surfaces provide a stable arrangement of the two pyramidal bollards 105 for lifting, moving, and positioning.

As shown in FIGS. 10C and 10D, the boom crane lifts the two pyramidal bollards 105 off the ground and can move and position the tandem of pyramidal bollards 105 as needed. To unload the pair of pyramidal bollards 105 from the clamshell bucket 1005, the process is reversed.

Example Barriers

The pyramidal bollards of the invention can be configured and manufactured for many different uses. The specific size relationships and weights of the pyramidal bollards can be selected depending upon the environment in which they are used. For example, in one embodiment of the invention, a pyramidal bollard weighs between 500-4,500 pounds, while in another embodiment, a pyramidal bollard weighs between 750-3,000 pounds. In one embodiment, a pyramidal bollard weighs between 1,000-1,500 pounds, such as 1,350 pounds, 1,370 pounds, or 1,390 pounds.

The relationship of the geometric dimensions can also be selected based upon the environment in which the barrier will be used. For example, in one embodiment, a pyramidal bollard has a base length of between 15-45 inches, while in another embodiment, a pyramidal bollard has a base length of between 20-40 inches. Similarly, in one embodiment, a pyramidal bollard has a base length of between 25-35 inches, while in one embodiment, a pyramidal bollard has a base length of 30 inches for each side of a square base.

The height of the pyramidal bollard also can be selected based upon the use of the barrier and the environment in which it will be used. For example, in one embodiment of the invention, a pyramidal bollard has a height of between 18-54 inches, and in another embodiment, a pyramidal bollard has a height of between 24-48 inches. Similarly, in one embodiment, a pyramidal bollard has a height of between 30-36 inches, and in one embodiment, a pyramidal bollard has a height of 36 inches.

In one embodiment, the pyramidal bollard is made of a precast material, such as a substance previously prepared for creating a material and/or a structure. In one embodiment, a precast material is a mixture of materials for creating a specific substance. For example, in one embodiment, a precast material is cement combined with other materials (e.g., gravel, sand, water, and other materials) to create concrete. In one embodiment, cement includes a mixture of finely ground materials, such as lime, clay, and other materials.

Hand Cart Example

In addition to lifting, moving, and positioning the pyramidal bollards of the invention with boom cranes, the barriers can also be lifted and moved with a customized hand cart in accordance with the invention. Boom cranes and clamshell buckets can be used to quickly lift, move, and place the pyramidal bollards. When finer movements are needed, a modified hand cart can be used in conjunction with the barriers of the invention.

Figure 1:
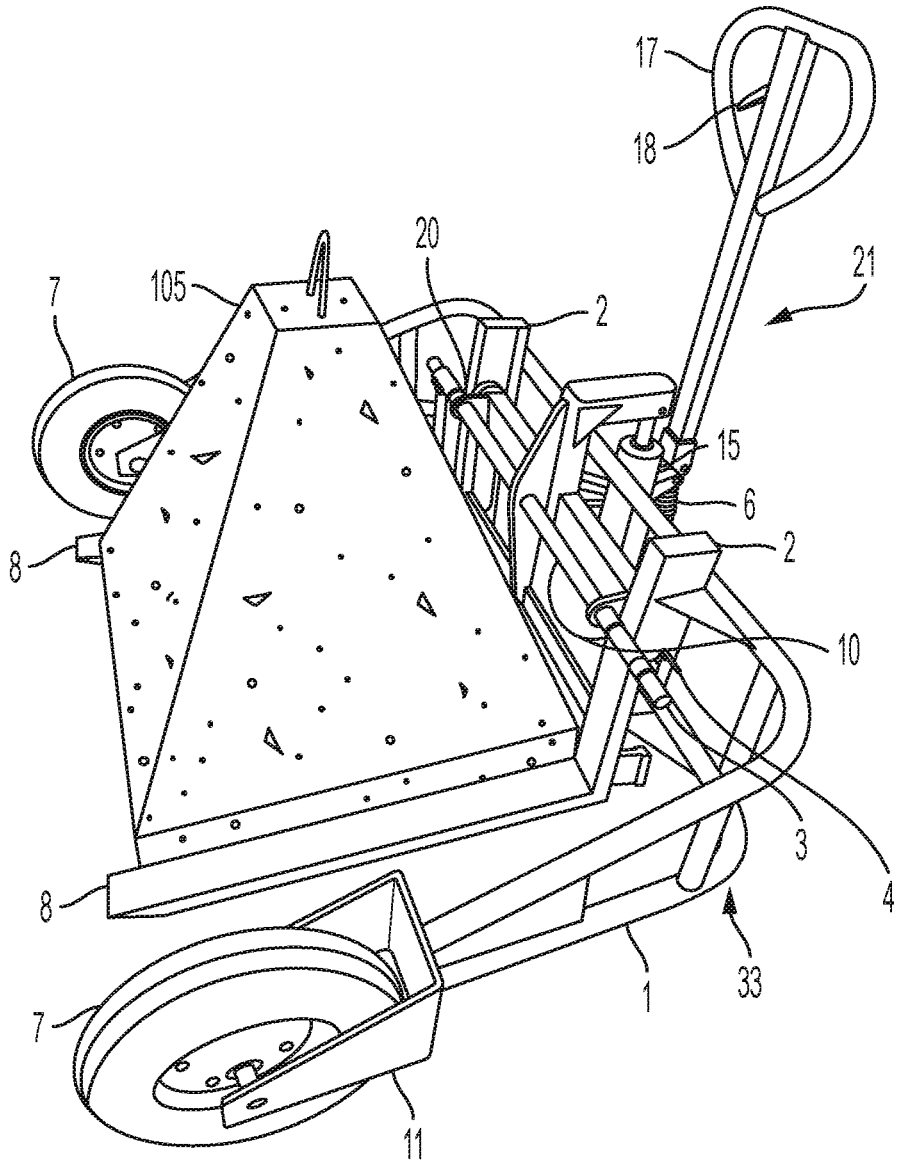
FIG. 1 is an exemplary illustration of a hand cart holding a pyramidal bollard in accordance with the claimed invention.
Figure 2:
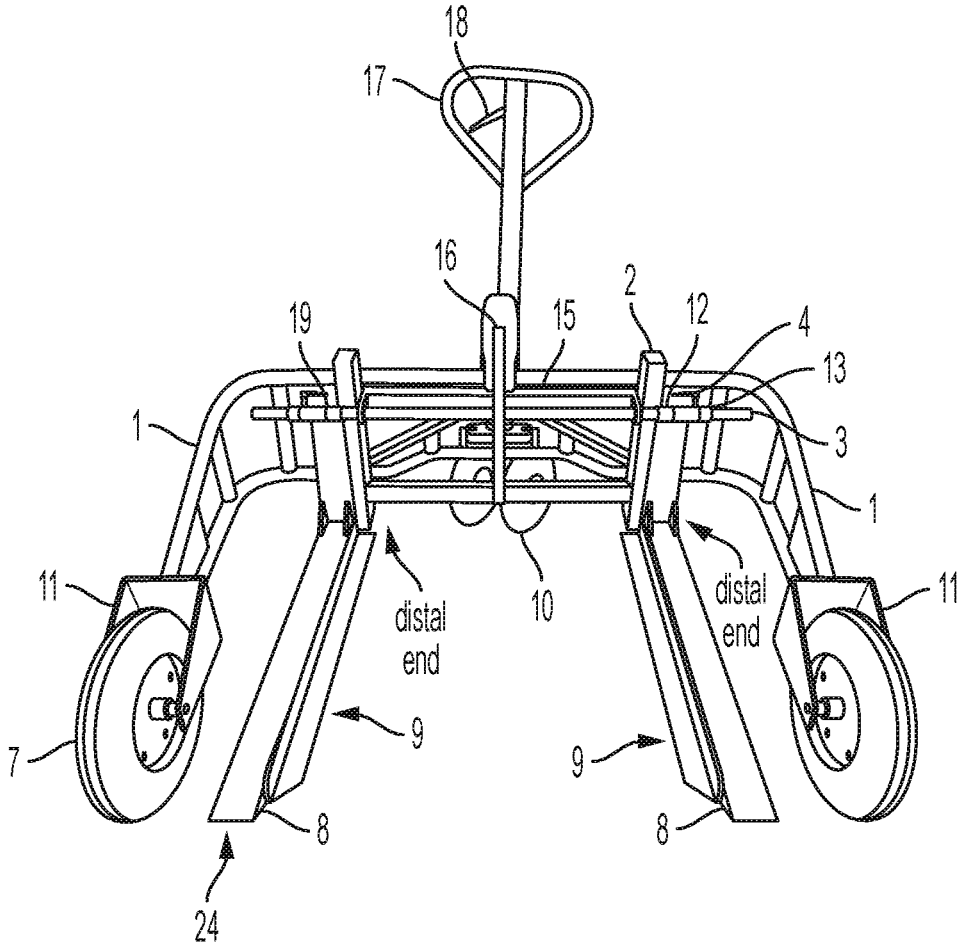
FIG. 2 is an exemplary illustration of a front view of a hand cart in accordance with the claimed invention.
Figure 3:
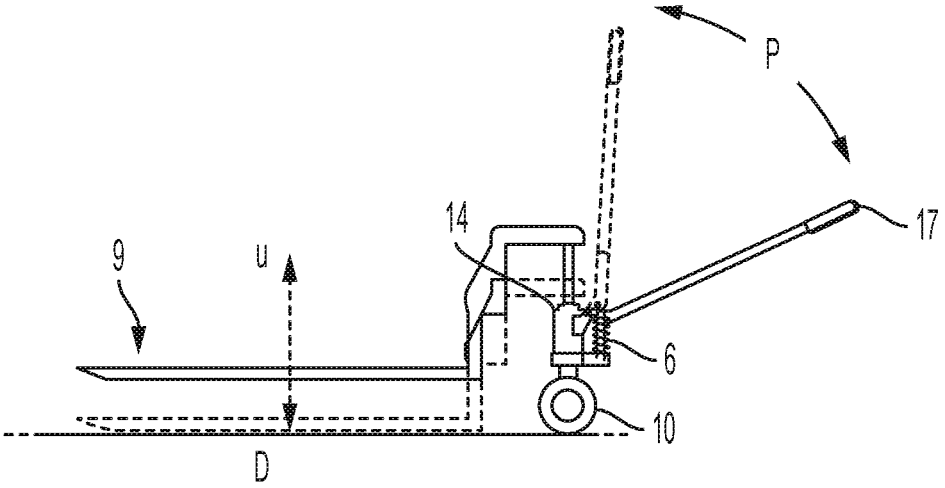
FIG. 3 is an exemplary illustration of a side view of a hand cart in accordance with the invention with forks moving up and down with a piston pump by moving a pull bar in an up and down motion.

FIG. 1 is an exemplary illustration of a hand cart 21 holding a pyramidal bollard 105 in accordance with the invention. FIG. 2 is an exemplary illustration of hand cart 21 with the pyramidal bollard removed. As shown in the FIGS., hand cart 21 includes a frame 33 that includes outwardly projecting outriggers 1 that are connected or integral with the frame 33. Outriggers 1 include front wheels 7 connected to wheel frames 11. The hand cart 21 also includes a pair of outwardly projecting forks 9 connected to the frame at a proximal end through horizontal slide bar 3 and lock handle 4. Additional wheels can be included in the outriggers, depending upon the weight and load to be moved.

In contrast to previously known hand carts that relied upon threaded rods with opposite hand threads that are rotated by a user to adjust the width of the prongs, the forks 9 of the invention slide inward and outward via slide bar 3. Once positioned, the lock handle 4 is engaged to prevent horizontal movement of the forks 9.

A pull bar 17 is mounted on the rear wheel 10 assembly and provides up and down movement to engage the jack 15. Additional wheels can be used in conjunction with the rear wheel 10 to provide additional stability and lifting capabilities. The pull bar 17 also moves wheel 10 in a lateral direction to move the hand cart side-to-side. The pull bar includes release trigger 18, which releases pressure in the hydraulic jack 15 allowing the hand cart 21 to lower to a down position. The piston on the hydraulic jack 15 pushes upward on the support 16 when the piston is extended, lifting the entire hand cart 21 upward and off the floor (support surface), with the hand cart 21 supported by the rear wheel 10 and the front wheels 7. In one example embodiment of the invention, the mechanical jack can be replaced with a screw thread jack for lifting the barriers.

Figure 4:
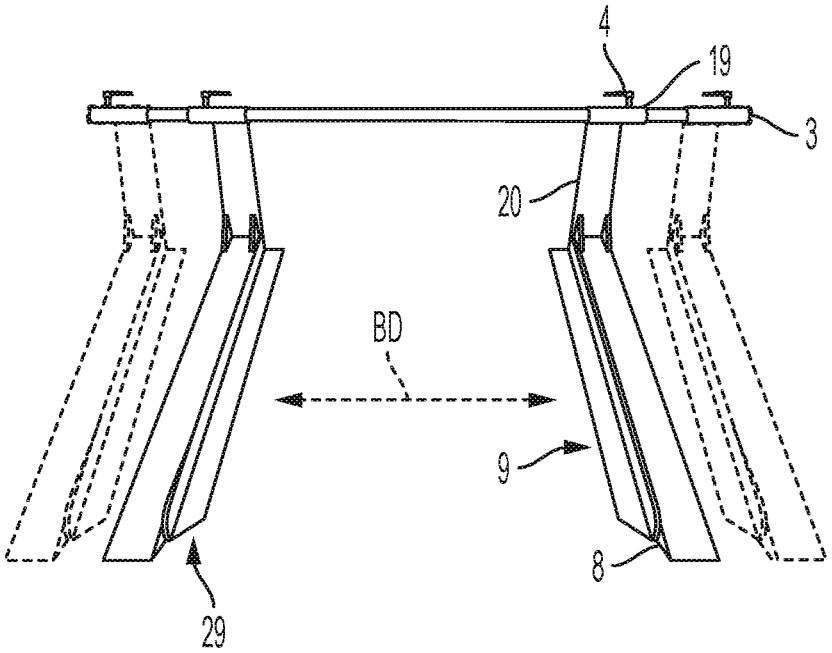
FIG. 4 is an exemplary illustration of a portion of a hand cart in accordance with the invention with a front view of forks moving along a slide bar.

Masts 2 are connected to the outriggers 1. Outriggers 1 comprise a plurality of horizontal and vertical tubes to provide stability for the hand cart 21 when it is carrying a load, such as a pyramidal bollard 105. In one example embodiment of the invention, outrigger 1 is composed of a metal, e.g., steel. Slide bar 3 is connected to mast 2. The forks 9 can include flanges 8. The forks 9 provide a surface with which to engage the respective lips 160 of the barrier 105 along indentations 130 (e.g., fits in the vertical distance between the lip 160 and the base 125 and/or the ground). Each of the forks 9 can be formed from channel members or solid members having a horizontal width and a vertical height positioned at substantially right angles. As shown in FIG. 4, the respective forks 9 can include a horizontal extension 29 that extends horizontally toward the opposing fork 9 and provides and additional horizontal surface width with which to engage the lip 160 of a barrier 125. The forks 9 are connected to slide bar 3 by panels 20.

Slide bar 3 also extends through support 16. Mast 2 is connected to reservoir 14, which is connected to jack 15 and piston pump 6. Stoppers 12 are placed on the interior of sleeves 19, and lock sleeves 13 are placed on the outside of sleeves 19. Lock sleeves 13 comprise lock handles 4. Pull Bar 17 with release trigger 18 is pivotably affixed to jack 15 and used to provide leverage to engage jack 15 to lift the forks 9 of the hand cart 21 up and down.

In one example embodiment of the invention, the hand cart 21 is manufactured and configured to match the size and shape of a barrier. That is, the forks 9 of the hand cart fit under the corresponding lip 160 or along indentation 130 of the barrier (as shown in FIGS. 6-10). With the forks 9 under the lips 160 and along indentations 130 of the barrier 105, the hand cart can be used to safely and securely lift the barrier. In one embodiment, the depth and height of an indentation, along with a barrier's overall height and weight, determines the dimensions of a hand cart for effectively lifting and moving the bollard. For example, a fork that is thinner than required may not support the weight of the particular barrier. In one embodiment of the invention, the distance between the forks of the hand cart is changeable by a user to match the dimensions of the barrier to be moved.

The maximum distance between the forks 9 depends on the overall size of the hand cart 21 and the distance between the respective wheels 7 on outriggers 10. As outlined above with regard to the barriers of the invention, in one example embodiment, a barrier 125 has a substantially square base with sides that are 30 inches long. For this embodiment of the invention, the spacing between the forks 9 would be approximately 30 inches. One example embodiment of the invention provides a range of spacing between the forks of 0-48 inches to accommodate many different sized barriers, with a wide range of adjustment so that the hand cart 21 can lift and transport barriers having different sized bases.

Once the forks 9 are positioned to accommodate and receive a particular barrier, stoppers 12 and the lock handle 4 is engaged on the slide bar 3 to prevent further movement of the forks 9 along the slide bar. Stoppers 12 and the lock handle 4 and lock sleeve 13 hold the forks 9 at a set width.

The pair of spaced parallel forks 9 extends outwardly from the frame 33 in a direction opposite the pull bar 17. The wheels 7 at the ends of the outriggers 1 support the distal ends of the prongs against a surface such as an asphalt parking lot, a concrete floor, or other surface upon which the bollard 105 may be placed. As shown further in FIG. 3, the jack 15 is raised by pumping the pull bar 17 up and down (back and forth along arrow P), causing the base of the jack 15 to bear against the support 16, lifting the forks 9 off the ground and allowing them to abut respective parallel sides of base 125. An optional compression coil spring (not shown separately) can be positioned between a flange portion of the support 16 and the bottom end of the pull bar 17 to urge the pull bar 17 upward after it has been pulled downward along arrow P by an operator to actuate the jack 15. As the hand cart 21 is brought toward barrier 105 and positioned as shown in FIG. 1, the forks 9 of the hand cart 21 are positioned under lips 160 of the barrier in indentations 130. The forks 9 of the hand cart can be manufactured and configured to be greater in length than the length of indentations 130. The rear wheel 10 and the wheels 7, located toward the outer ends of the forks, remain in constant contact with the floor or ground allowing the loaded pallet jack to be easily moved.

Each distal end (closest to wheels 7) of the forks 9 can include a flange 8 or rounded or tapered leading edge 24, which facilitates insertion of the forks 9 under the lips 160 of the pyramidal bollard 105. Additionally, beneath each tapered leading edge 24, a support caster (not shown) can be mounted to facilitate placement of the forks 9 under the lips 160 in the indentations 130.

Returning to FIG. 3, as the pull bar 17 engages the piston pump 6 of jack 15, the lifting action of the jack 15 on the support 16 and on rear wheel 10 is translated to the forks 9, which are lifted off the ground (support surface) as shown along line U-D in FIG. 3 and against lips 160 of the barrier 105. As the pull bar 17 is further engaged, the forks 9 continue to exert an upward force on the lip 160 until the barrier is lifted off the ground (support surface) and is held by the forks 9.

While a fully mechanical hand cart 21 is shown in the FIGS, other example embodiments of the invention include a hand cart with a power supply that can be used to provide lifting action (e.g., using an electric jack) or to provide forward, backward, and lateral motion of the hand cart.

FIG. 4 is an exemplary illustration of an example front view of forks 9 with flanges 8, where the forks 9 are movable along slide bar 3 using panels 20. The forks 9 can be moved along base dimension (shown as arrow BD in FIG. 4) to fully engage the base 125 of a pyramidal bollard 105 under the lips 160 of the pyramidal bollard 105 along indentations 130. As outlined above, different barriers may have different sized bases. By moving panels 20 along slide bar 3, the forks 9 can be moved to accommodate and fit the base of a given barrier. Once the desired base dimension is determined, and the forks 9 are moved to their respective positions, lock handle 4 is engaged to secure panel 20 in place.

Figure 5:
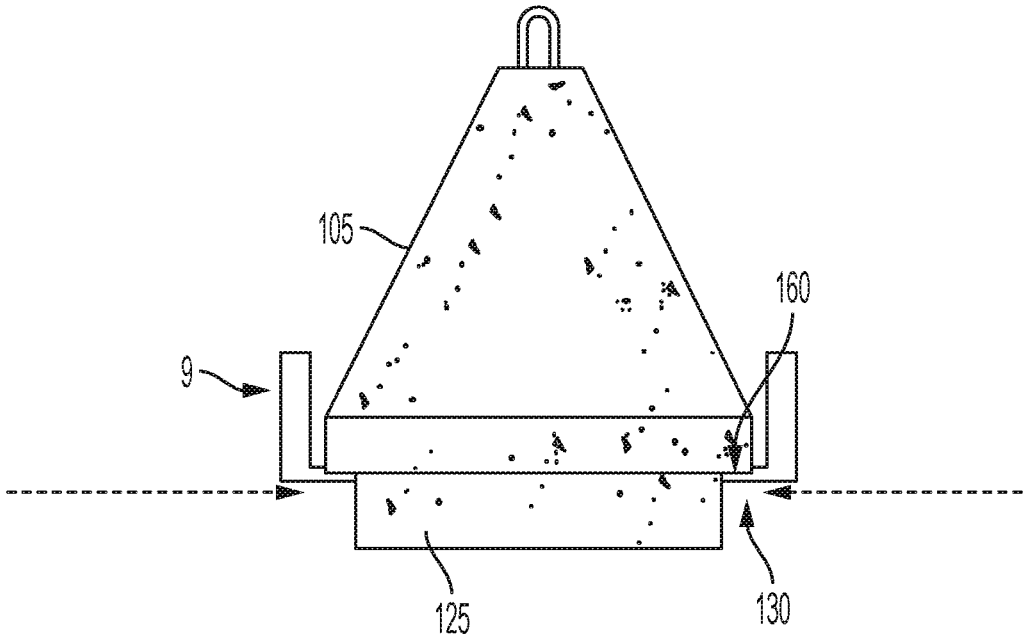
FIG. 5 is an exemplary illustration of a front view of a hand cart in accordance with the invention with forks engaging a barrier in accordance with the claimed invention.

FIG. 5 shows an exemplary illustration of forks 9 engaging the lip 160 of an example pyramidal bollard 105. The forks 9 are shown in FIG. 5 in an exaggerated view to provide details regarding the manner by which they slide along base 125 of the pyramidal bollard 105 in indentations 130 underneath the lip. In this fashion, the forks 9 latch onto the pyramidal bollard 105 and alongside the base 125.

In one example embodiment of the invention, the base 125 is approximately 30 inches long, so in use, the forks 9 are configured to be 30 inches apart to allow for an example hand cart 21 to securely attach to the bottom of the base 125 and to lift the pyramidal bollard 105 above the ground when engaging the pull bar 17 and jack 15. By moving the forks 9 along the slide bar 3 and then locking the slide bar 3 in place using the lock handle 4, the hand carts of the invention are customizable to securely attach to barriers of various lengths along the base of the respective barriers.

Once the forks 9 are positioned along the base 125 of a pyramidal bollard 105, a user can lift and move the barrier to position it on a support surface, including floors, parking lots, sidewalks, roadways, paths, or other support surfaces.

Molds

In some embodiments, concrete pyramidal bollards in accordance with the invention can be produced using molds specially configured to the specifications of the example pyramidal bollards described above. By locating molds to configure and produce the pyramidal bollards, they may be manufactured close to their point of use, thereby avoiding expensive shipping charges to transport the heavy and bulky barriers.

Figure 9:
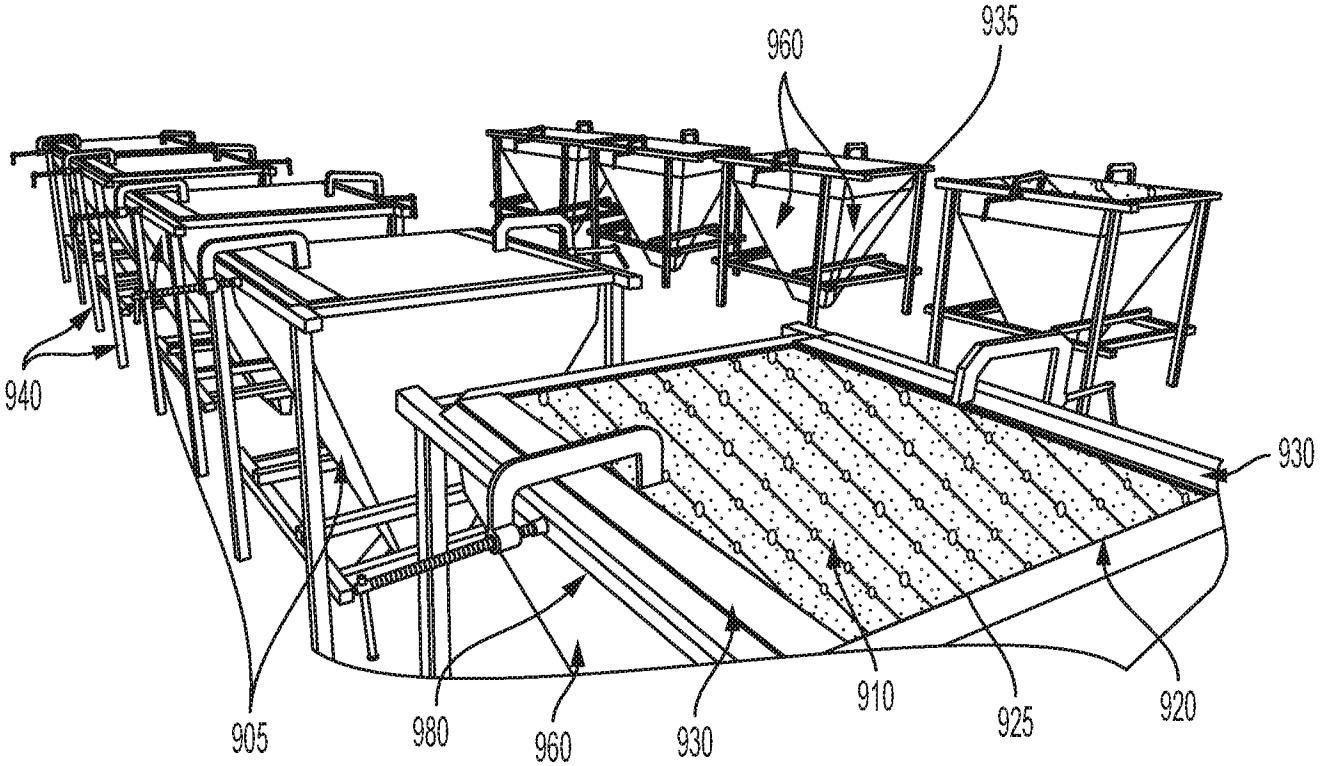
FIG. 9 shows several pyramidal bollard molds in accordance with the invention filled with concrete and curing to produce a number of pyramidal bollards in accordance with the invention.

FIG. 9 shows pyramidal bollards in accordance with the invention formed using mold 905 which can be filled with concrete. The mold 905 is sized and configured to produce pyramidal bollards of this invention with the geometric characteristics outlined in the above examples. In one example embodiment of the invention depicted in FIG. 9, a mold assembly includes the molds 905 that are configured and manufactured to define a cavity 910 in which the pyramidal bollards are cast. The cavity 910 is disposed between side walls 960 of the mold 905 for receiving and molding concrete barriers. The mold 905 includes a rectangular top portion 935 formed as a bottom surface of the mold 905, the rectangular top portion 935 includes a length and a width. The mold 905 includes four planar side walls 960, each in cooperation with the rectangular top portion 935 and extending vertically from the rectangular top portion 935 to a rectangular curb portion 980 at substantially the same angle of inclination, wherein the combination of the rectangular curb portion 935, the four planar side walls 960, and the curb portion 980 form an inverted truncated pyramid. The mold 905 also includes a pair of rectangular base inserts 930 in cooperation with the four planar side walls 960, wherein the rectangular base inserts 930 are positioned at the open top 920 of the mold 905 to form a rectangular base area 925 and an overhang recess (corresponding to indentation 130 in FIG. 6, for example) between the rectangular base area and the rectangular curb portion 935. The rectangular base inserts 930 can be clamped or otherwise secured to the mold frame 940, as shown in FIG. 9.

A crane or similar lifting device may be attached to the mold assembly 940 for lifting the mold 905 for rotation and removal of the formed pyramidal bollard after curing. The illustrated mold assembly 940 and the molds 905 themselves can be made of a metal or metal alloy material for strength and durability.

CONCLUSION

Although the present invention has been described with reference to various exemplary embodiments, it is to be understood that these embodiments are merely illustrative of the principles and applications of the invention. Those having skill in the art would recognize that various modifications to the exemplary embodiments may be made, without departing from the scope of the invention.

Moreover, various features and/or characteristics of differing embodiments herein may be combined with one another. It is therefore to be understood that numerous modifications may be made to the illustrative embodiments and that other arrangements may be devised without departing from the scope of the invention.

Within the context of this disclosure, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Furthermore, other embodiments of the invention will be apparent to those skilled in the art from consideration of the specification and practice of the invention disclosed herein. It is intended that the specification and examples be considered as exemplary only, with a scope and spirit being indicated by the claims.

What is claimed is:

1. A barrier to vehicular passage comprising:

a rectangular base formed as a bottom support surface of the barrier, the rectangular base including a length, a thickness, and a width;

a rectangular curb formed above the base and in cooperation with the rectangular base, the rectangular curb including a length, a thickness, and a width, wherein the length and width of the rectangular curb extends beyond the length and width of the rectangular base to form one or more overhanging lips to provide lifting points to move the barrier;

four planar sides each in cooperation with the rectangular curb and extending vertically from the rectangular curb to a top portion at substantially the same angle of inclination, wherein the combination of the rectangular curb, the four planar sides, and the top portion form a truncated pyramid above the rectangular base and in cooperation with the rectangular base.

2. The barrier to vehicular passage of claim 1, wherein the rectangular base, the rectangular curb, and the top portion are substantially parallel.

3. The barrier to vehicular passage of claim 1, wherein the top portion includes a length, and the length of the rectangular curb is greater than the length of the top portion.

4. The barrier to vehicular passage of claim 1, wherein each of the four planar sides has a length and a width, and wherein the four planar sides are two pairs of opposing planar sides, and wherein each of the opposing planar sides has substantially the same respective length and the same respective width.

5. The barrier to vehicular passage of claim 1, wherein each of the four planar sides has a length and a width, and wherein the four planar sides are two pairs of opposing planar sides, and wherein each of the opposing planar sides of the pair of planar sides has substantially the same respective length and the same respective width.

6. The barrier to vehicular passage of claim 1 further comprising:

an attachment point embedded in the top portion of the barrier, wherein the attachment point is at least one of a hook and loop.

7. The barrier to vehicular passage of claim 1, wherein the barrier is made of a pre-cast material, and wherein the precast material is at least one of cement and concrete.

8. The barrier to vehicle passage of claim 1, wherein the width of the rectangular curb extends beyond the width of the rectangular base in both lateral directions to form the one or more overhanging lips.

9. The barrier to vehicular passage of claim 1, wherein the length and the width of the rectangular base are substantially the same and the length and width of the rectangular curb are substantially the same.

10. The barrier to vehicular passage of claim 9, wherein the top portion includes a length and a width, and the length and the width of the top portion are substantially the same.

* * * * *